US006820456B2

(12) United States Patent
McClellan et al.

(10) Patent No.: US 6,820,456 B2
(45) Date of Patent: Nov. 23, 2004

(54) VEHICLE-STRAIGHTENING BENCH WITH MOVABLE CARRIAGES FOR MOUNTING PULLING ASSEMBLIES

(75) Inventors: Daniel R. McClellan, Grand Island, NE (US); Richard H. Nagorski, Grand Island, NE (US); Jeffrey L. Dobbins, Grand Island, NE (US); Jeffery A. Hess, Grand Island, NE (US); Charles A. Schulte, Omaha, NE (US); Nathan Adams, Littleton, CO (US); Robert W. Thomas, Grand Island, NE (US); Marco Tulio Nossa Reyes, Verdun (MX)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/990,865

(22) Filed: Nov. 15, 2001

(65) Prior Publication Data

US 2003/0089154 A1 May 15, 2003

(51) Int. Cl.[7] ..... B21D 1/14
(52) U.S. Cl. ..... 72/457; 72/705
(58) Field of Search ..... 72/705, 446, 447, 72/457; 269/9, 58, 59

(56) References Cited

U.S. PATENT DOCUMENTS

| | | | | |
|---|---|---|---|---|
| 4,088,006 A | | 5/1978 | Patten | |
| 4,313,335 A | | 2/1982 | Eck | |
| 4,398,410 A | * | 8/1983 | McWhorter et al. | 72/457 |
| 4,520,649 A | * | 6/1985 | Barton, Sr. | 72/457 |
| 4,530,232 A | * | 7/1985 | Smith | 72/447 |
| 4,823,589 A | | 4/1989 | Maxwell, Jr. et al. | |
| 4,932,236 A | * | 6/1990 | Hinson | 72/447 |
| 4,986,107 A | | 1/1991 | Peyret | |
| 5,027,639 A | * | 7/1991 | Hinson | 72/457 |
| 5,111,680 A | * | 5/1992 | Ballard et al. | 72/447 |
| 5,131,257 A | * | 7/1992 | Mingardi | 72/457 |
| 5,189,899 A | | 3/1993 | Hsu | |

(List continued on next page.)

FOREIGN PATENT DOCUMENTS

| | | |
|---|---|---|
| DE | 42 29 501 A1 | 3/1994 |
| DE | 196 12 852 A1 | 10/1997 |
| EP | 0 282 176 A2 | 9/1988 |
| EP | 1 106 273 A2 | 6/2001 |
| FR | 2 246 322 | 5/1975 |

*Primary Examiner*—Allen Ostrager
*Assistant Examiner*—John S. Goetz
(74) *Attorney, Agent, or Firm*—Kyle L. Elliott; Spencer Fane Britt & Browne LLP

(57) ABSTRACT

A vehicle-straightening bench (20) is utilized to apply pulling forces to a damaged vehicle chassis to restore the damaged chassis to an original configuration. The bench includes a vehicle platform (22) with a carriage track (24) having a plurality of carriage assemblies (100) movably received by the carriage track (24). Each carriage assembly (100) supports a pulling assembly (200) for applying the pulling forces. A trapezoidal carriage body (102) of the carriage assembly (100) rolls in the carriage track (24), and the carriage assembly also includes a tower positioning mechanism (104) to hold the pulling assemblies (200) in place while the carriage body (102) is are rolled on the track (24). The carriage assembly (100) also includes a locking mechanism (106) to lock them in place during a vehicle a pull. A force arm (206) is extended between the pulling mechanism (200) and the platform (22), so that the carriage assembly (100) is not the only force transmission path between the pulling assembly (200) and the bench (20). The automated control system (300) of the bench (20) utilizes two hydraulic pumps(316, 314) to power front and back lifts (65, 64), respectively. Only one of the pumps (314) is used by the pulling assemblies (200). A PLC (308) and a remote control (310) are used to control the bench (20).

3 Claims, 13 Drawing Sheets

U.S. PATENT DOCUMENTS

| | | | |
|---|---|---|---|
| 5,199,289 | A | 4/1993 | Hinson |
| 5,263,357 | A | 11/1993 | Dumais |
| 5,355,711 | A | 10/1994 | Chisum |
| 5,596,900 | A | 1/1997 | Pietrelli |
| 5,623,846 | A | 4/1997 | Brewer, Jr. |
| 5,640,878 | A | 6/1997 | Hinson |
| 5,918,500 | A | 7/1999 | Brewer, Jr. |
| 5,931,043 | A | 8/1999 | Liegel et al. |

* cited by examiner

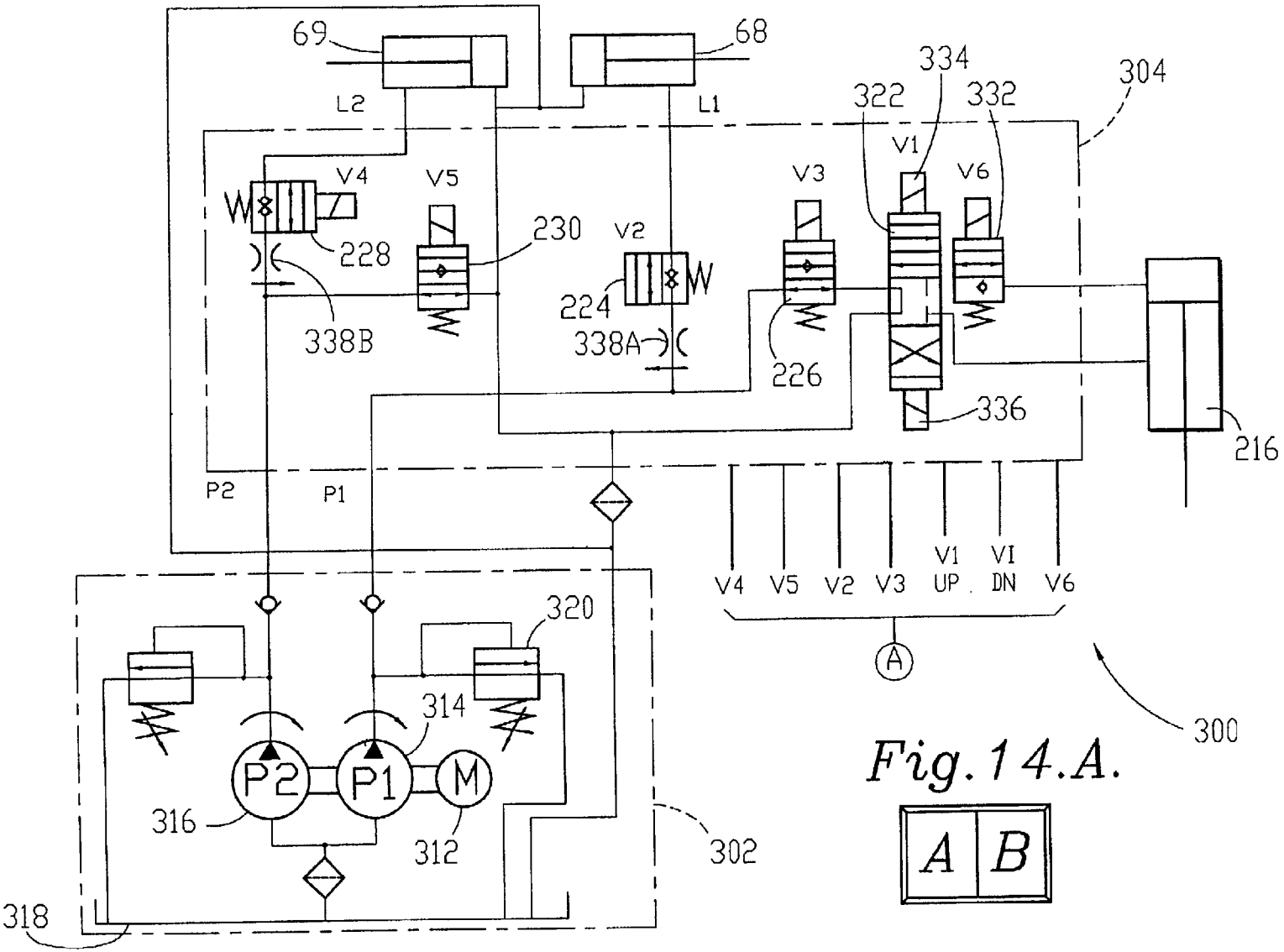
Fig. 14.A.
A B

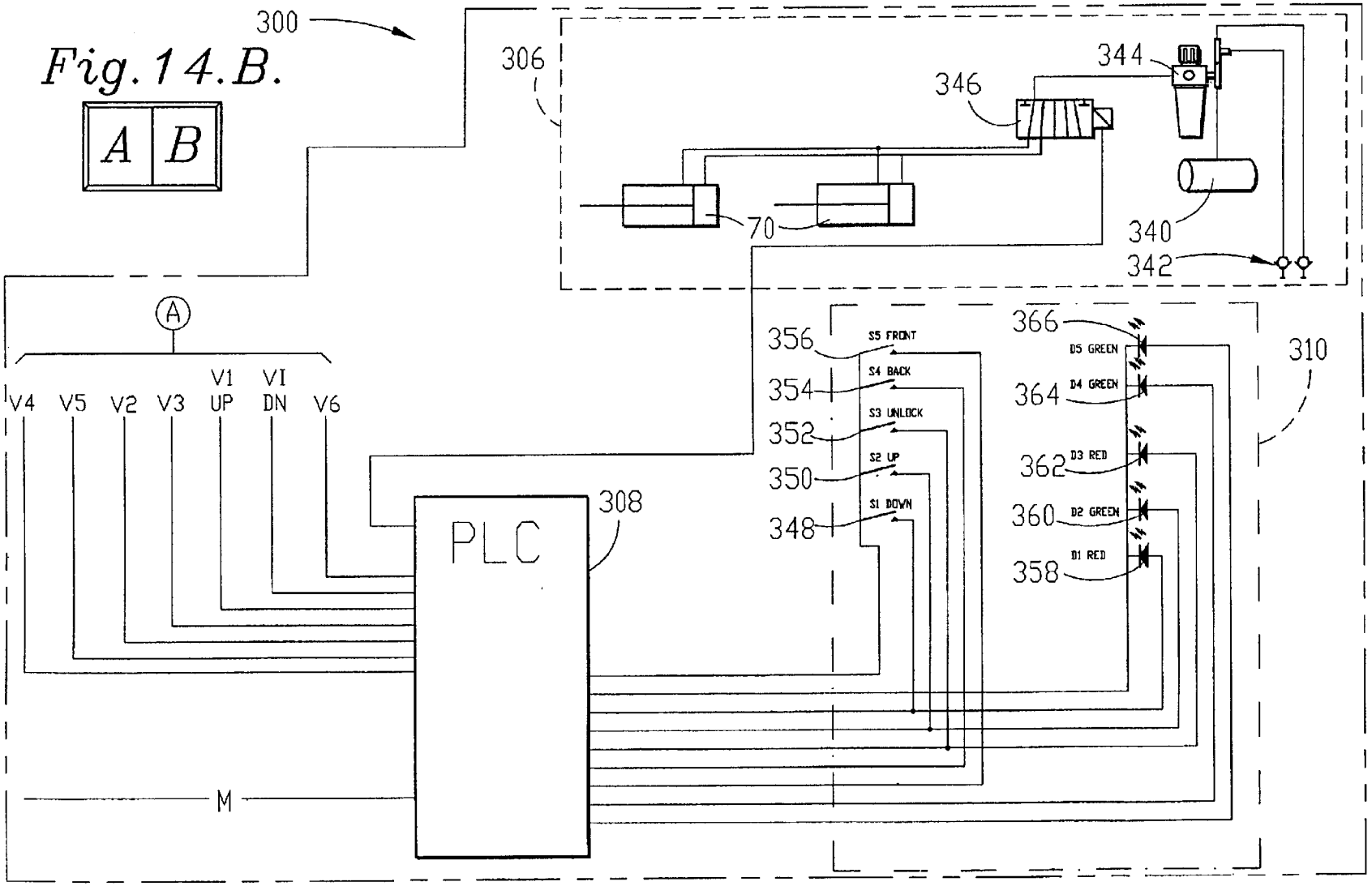
Fig. 14.B.
A B

VEHICLE-STRAIGHTENING BENCH WITH MOVABLE CARRIAGES FOR MOUNTING PULLING ASSEMBLIES

FIELD OF THE INVENTION

This invention relates to apparatus used to straighten vehicle chassis of automobiles, vans, SUV's, trucks and other vehicles and, more particularly, to vehicle-straightening benches having platforms for supporting and anchoring vehicles while pulling assemblies apply forces at desired locations and in desired directions thereby restoring the vehicle chassis to original configurations.

BACKGROUND OF THE INVENTION

Occasionally, vehicles are involved in collisions, and before they can reenter meaningful service, the vehicle chassis must be returned, as nearly as possible, to their original configurations. This is frequently accomplished with straightening benches. A typical straightening bench includes a platform for supporting and anchoring a vehicle chassis while forces are applied to the chassis by pulling assemblies. The pulling assemblies utilize hydraulically powered telescoping towers with chains that attach to desired locations on the vehicle chassis. To hold them in place, the pulling assemblies are secured to the bottom of the platform while force is applied to the chassis. In many designs the pulling assemblies are permanently mounted to the bottom side of the platform. With the pulling assemblies mounted on the platform, the large hydraulic pulling forces exerted by the towers create even larger moments and forces where the pulling assemblies are mounted to the platform. Thus, the pulling assembly mounts must be excessively over designed and occasionally fail rendering the pulling assembly inoperable. Further, the pulling assembly mounts unduly limit the possible positions of the pulling assemblies and hence restrict an operator's ability to apply force in any desired direction.

Many straightening benches utilize platforms, which can be raised and lowered with hydraulic lifts. Typically, the same hydraulic pump is used to power both the platform lift and the pulling assemblies. However, there are competing hydraulic design criteria for the lifts and the pulling assemblies. For the lifts, it is desirable to have a high volume pump, so that the lift does not operate too slowly, but the high-force pulls need more control requiring a low volume pump. More simply put, the lift should operate relatively fast and the towers of the pulling assemblies should operate relatively slow. To date, no satisfactory solution has been presented for these competing hydraulic design criteria. Additionally, prior straightening benches have lacked sufficient automation of locking mechanisms, and operators have been required to manually release valves and lock mechanism, which places the operators dangerously close to the straightening bench.

BRIEF SUMMARY OF THE INVENTION

There is therefore provided in the practice of the invention a novel vehicle-straightening bench which provides increased versatility, improved force control, and enhanced safety, for straightening vehicle chassis by the measured application of hydraulic force to the vehicle chassis. The vehicle straightening bench broadly includes a vehicle platform operable to support a vehicle chassis and an anchor attachable to the platform for securing the vehicle chassis to the platform. A pulling tower is provided to apply force to the vehicle chassis. A carriage assembly is moveably received by a carriage track, which is mounted on the platform, and the pulling tower is mounted on the carriage assembly.

In a preferred embodiment, the pulling tower is pivotally mounted on the carriage assembly, and the carriage assembly includes a tower positioning mechanism. The tower positioning mechanism engages a tower arm which extends between the pulling tower and the carriage assembly to mount the pulling tower to the carriage assembly. The positioning mechanism holds the pulling tower in a transport position substantially perpendicular to the bench while the pulling tower and carriage assembly are moved along the carriage track. The preferred positioning mechanism includes a pawl follower fixedly mounted on the tower arm and a notch plate mounted on the carriage assembly. The notch plate defines a notch, which receives the pawl follower, so that the pulling tower is substantially perpendicular to the bench when the pawl follower is received in the notch. A pawl biasing member, which is preferably a pawl spring, engages the pawl follower and forces it toward the notch plate and into the notch to hold the pulling tower in the transport position.

Preferably, the carriage assembly includes a carriage body defining a lock pin opening and further comprises a locking mechanism having a lock pin moveably received in the lock pin opening. A lock pin biasing member, preferably a compression spring, also received in the lock pin opening, engages the lock pin to bias the lock pin into an extended locking position. Once the lock pin is in the locking position, which locks the carriage assembly in place relative to the vehicle platform and carriage track, an operator applying a force will overcome the pawl biasing member thereby forcing the pawl out of the notch and pivoting the pulling tower relative to the carriage assembly. Preferably, the lock pin is coaxial with the pivot axis of the pulling tower. The locking mechanism also includes a release handle operative to release the lock pin when moved vertically downward.

A preferred carriage assembly includes a generally trapezoidal carriage body having a inwardly facing narrow end and an outwardly facing wide end. A single inner wheel is mounted on the narrow end of the carriage body for engaging the platform adjacent an inner rail of the carriage track. Two outer wheels are supported on an outer rail of the carriage track. The outer wheels preferably include circumferential ridges, which engage a wheel slot defined by the outer rail. Further, a guide is forced against the outer rail by a guide spring, and a pair of guide rollers are positioned adjacent the outer wheels. Preferably, the carriage assembly alone supports the pulling tower above the ground surface.

In another aspect of the invention, the bench utilizes a force arm which has one end substantially fixed to the pulling tower and a free end capable of pivoting in three dimensions relative to the pulling tower. The force arm is preferably telescoping and includes a pivoting anchoring foot configured for insertion in anchoring apertures defined in the platform. The pivoting anchoring foot rotates to lock in the platform anchoring apertures. The force arm provides additional support to the pulling tower and carriage assembly when hydraulic force is applied to the vehicle chassis by the pulling tower.

In still another aspect of the invention, the vehicle-straightening bench utilizes a moveable crossmember extended between inner sides of opposed legs of the vehicle-straightening bench. Opposite ends of the crossmember slideably engage slide tracks formed on the inner sides of the opposed legs of the bench. Two position locks are located at the ends of the crossmember and are operable to lock the crossmember in a selected position on the bench. The slide tracks define lock openings and each position lock includes a pivotally mounted lock rod. A rod biasing member forces the lock rods into the lock openings defined in the leg tracks to hold the crossmember in position.

In still another aspect of the present invention, the vehicle-straightening bench preferably includes a hydraulic control circuit. In a preferred embodiment of the bench having front and rear lifts, the hydraulic control circuit includes front and rear sets of lift control valves operative to actuate the front and rear lifts independently and/or simultaneously. A tower control valve is also provided which in conjunction with the front and rear lift control valves is operable to permit actuation of the pulling tower only when the lift control valves are closed. The bench also preferably includes a pneumatic control circuit with first and second pneumatic cylinders operable to move first and second lift latches which engage the lifts to lock them in desired positions. A remote control is provided to operate both the pneumatic and hydraulic control circuits. The control system utilizes a programmable logic controller to transmit instructions to the respective valves and cylinders.

Accordingly, it is an object of the present invention to provide an improved vehicle-straightening bench for straightening vehicle chassis.

It is another object of the present invention to provide an improved carriage assembly for movement and increased positioning versatility of pulling towers around a vehicle-straightening bench.

It is still another object of the present invention to provide an improved vehicle straightening bench control circuit for remote actuation of valves and cylinders.

It is a further object of the present invention to provide an improved pulling assembly having an additional force transmission path between a pulling tower and a vehicle platform of a vehicle-straightening bench.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein:

FIGS. 14A & B illustrate a control system schematic for the bench of FIG. 1.

DETAILED DESCRIPTION

Figure 1:
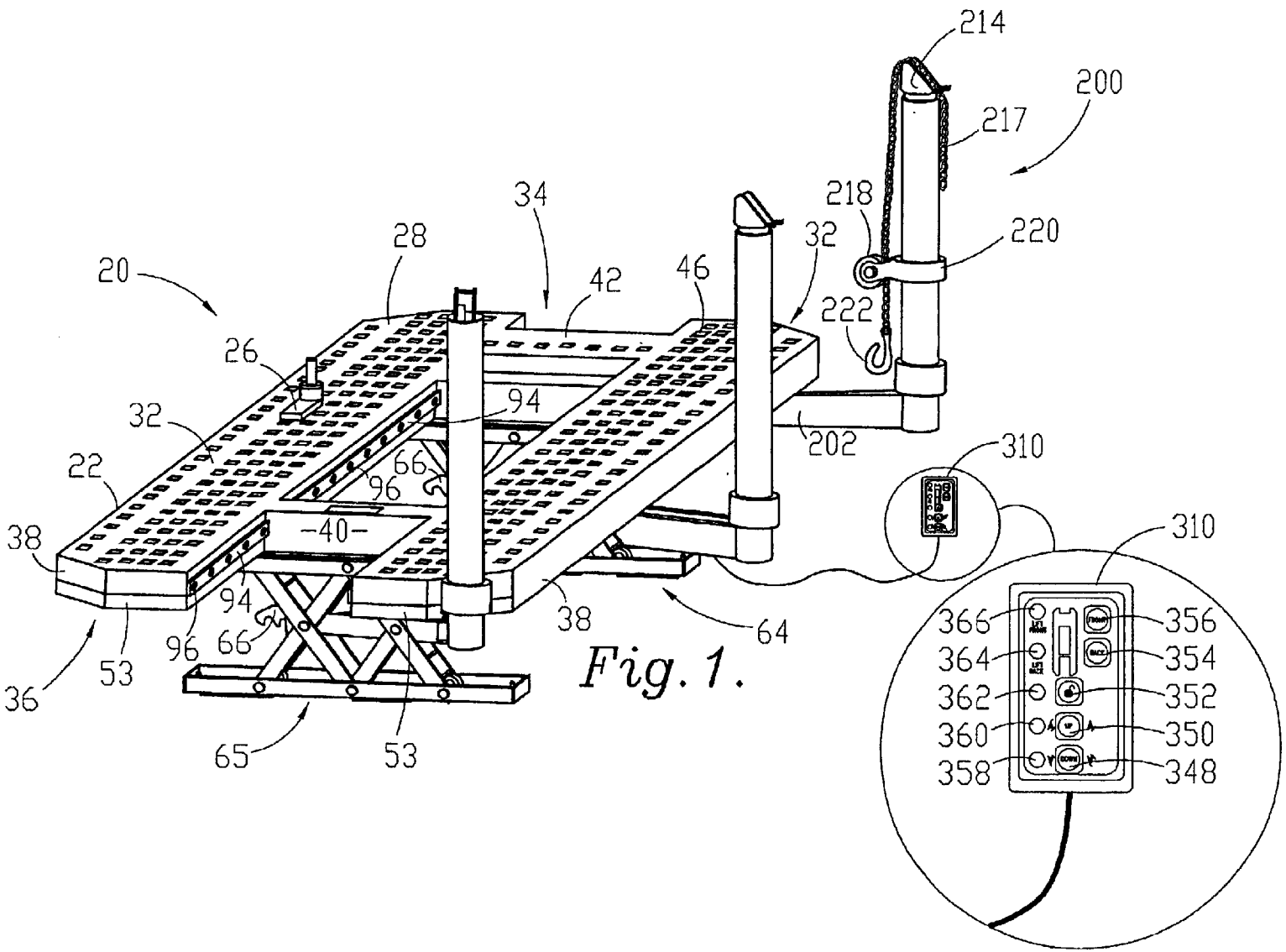
FIG. 1 is a perspective view of a vehicle-straightening bench according to the present invention and including a plurality of carriage assemblies (hidden) and pulling assemblies.
Figure 2:
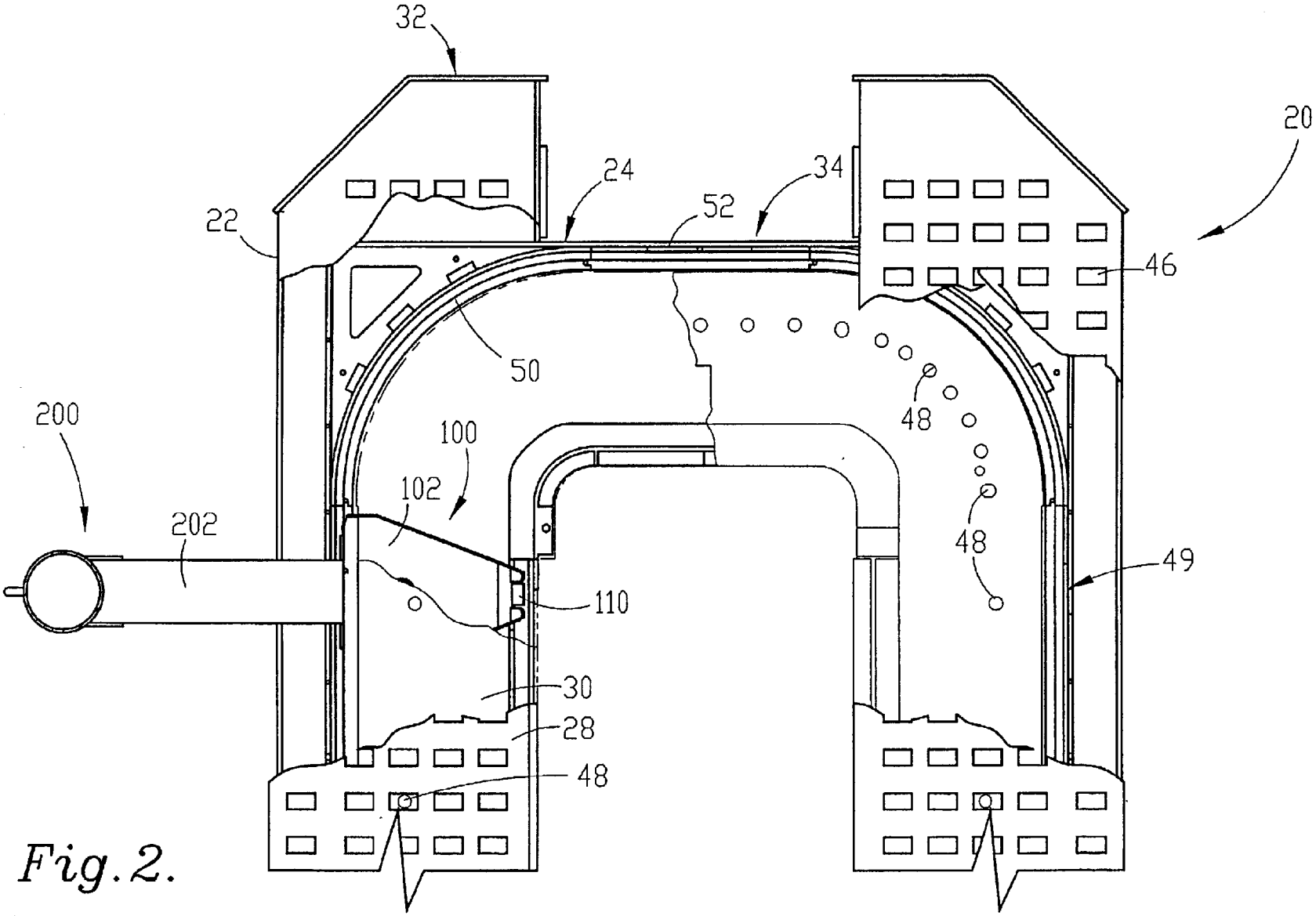
FIG. 2 is a top view of the bench of FIG. 1 having sections broken away to reveal a lower deck, a carriage track, and a carriage assembly.

Referring to the drawings in greater detail, FIGS. 1 and 2 show a vehicle straightening bench 20 constructed in accordance with a preferred embodiment of the present invention. The bench 20 broadly includes a vehicle platform 22 providing a carriage track 24, a plurality of carriage assemblies 100 movably received by the carriage track 24, and a plurality of pulling assemblies 200 are movably mounted to the platform 22 by the carriage assemblies 100. Further, the pulling assemblies 200 can pivot on the carriage assemblies 100. The bench 20 is provided with an automated control system 300 (FIG. 14) enabling remote operation of the bench power system 302 and safety mechanisms. The vehicle platform 22 is operable to support a vehicle chassis (not shown), and a plurality of anchors 26 (one shown), which can be positioned at different locations on the platform 22, attach to the vehicle chassis at selected locations holding it in a substantially fixed position relative to the platform 22. While the vehicle chassis is secured, the pulling assemblies 200 are moved to desired locations around the bench 20 and locked in position. The pulling assemblies 200 then apply force to the vehicle chassis at desired locations and in desired directions. The carriage assemblies 100 are substantially identical and the pulling assemblies 200 are substantially identical, and they will be described in the singular at times for clarity with the understanding that the description applies to all of the respective assemblies.

Figure 11:
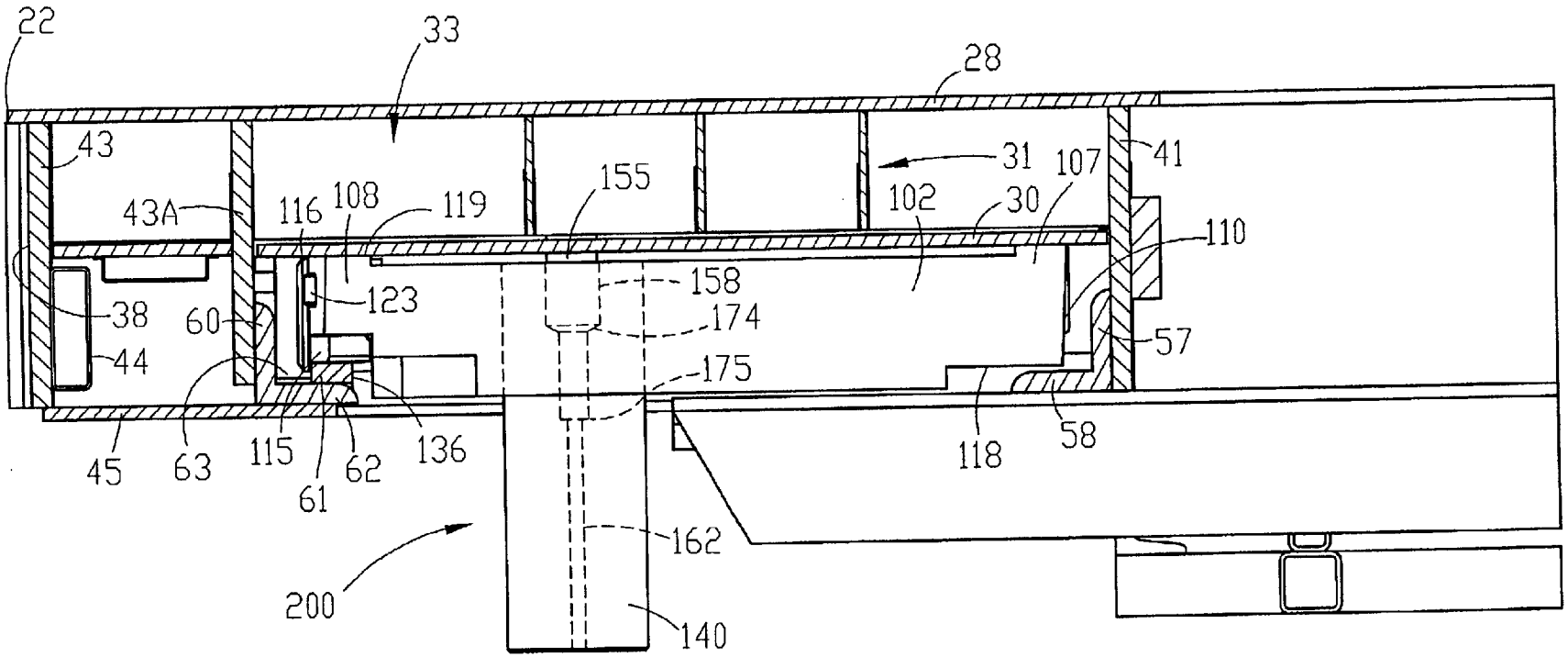
FIG. 11 is a fragmentary vertical cross-sectional view of a platform of the bench of FIG. 1 having one of the carriage assemblies illustrated in FIG. 2 received in the carriage track under the platform.

Referring additionally to FIG. 11, the vehicle platform 22 is substantially rigid and includes an upper deck 28 defining a top of the platform and a lower deck 30 defining a bottom of the platform. The upper and lower decks 28, 30 are joined by a plurality of rigid webs, generally designated 31, which spaces the decks 28, 30 apart to define an internal platform cavity 33. The upper and lower decks 28, 30 form legs 32 which extend over a desired length from the front 34 to the rear 36 of the of the bench 20 and define the sides 38 of the platform 22. The platform legs 32 are joined by a perpendicular rear cross beam 40 and a perpendicular front cross beam 42, which also serves to provide at least part of a protective housing for the bench control system 300 and power system 302. The upper and lower decks 28, 30 are also joined by an inner side wall plate 41 and outer wall plates 43. The wall plates 41, 43 extend below the lower deck 30 and hence below the bottom of the platform to define a track mounting area below the bottom of the platform. An outer bottom plate 45 extends across the gap between the outer wall plates 43. A hollow rectangular tube 44 is mounted between the outer wall plates 45 and functions as a conduit for hydraulic hoses (not shown) and other supply and power lines as required.

The upper deck 28 defines a plurality of anchoring apertures 46 spaced apart and positioned between the webs 31. The anchoring apertures 46 are preferably rectangular and are configured to receive components of the anchors 26. The lower deck 30 defines a plurality of lock pin apertures 48, which are substantially uniformly spaced along straight lines in the legs 32. In the front corners of the platform 22, the lock pin apertures 48 are more closely spaced and extend around a radius, which follows an arc of the carriage track 24 in the front platform corners.

Figure 4:
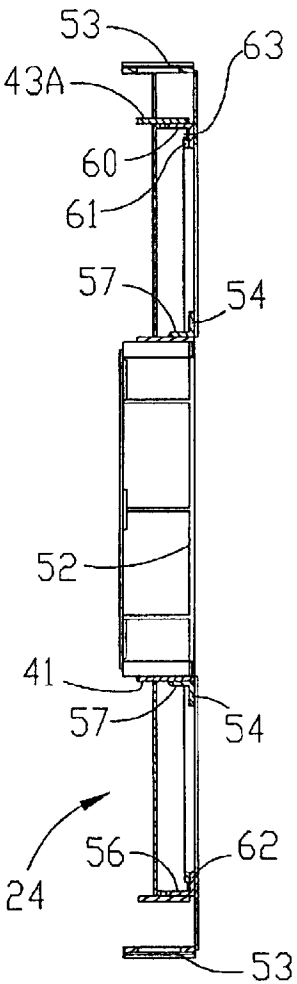
FIG. 4 is an end view of the carriage track shown in FIG. 2.
Figure 3:
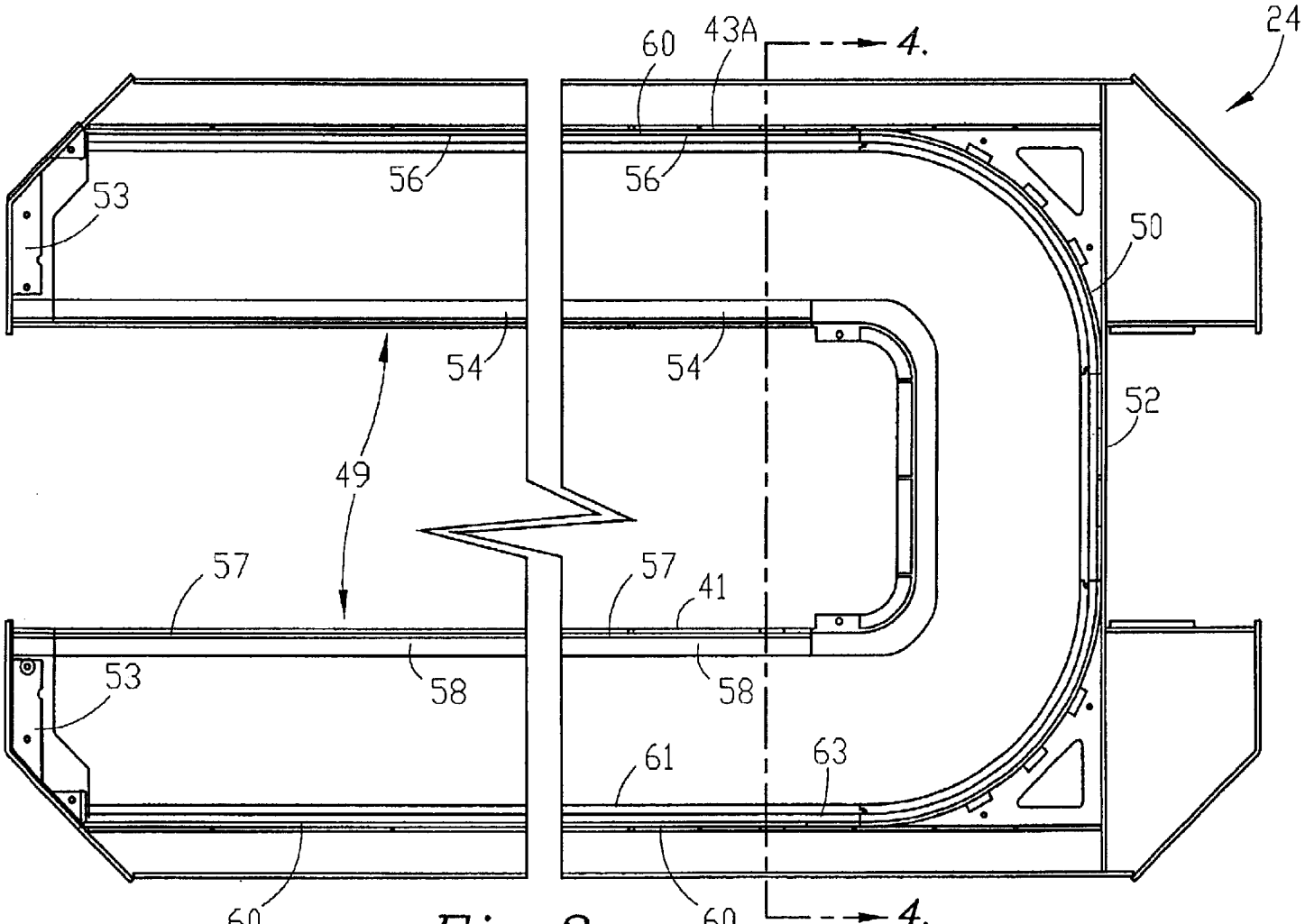
FIG. 3 is a top view of the carriage track shown in FIG. 2.

Referring to FIGS. 2, 3, and 4, the carriage track 24 extends along the length of the platform 22 and along both sides 38 of the platform. The carriage track 24 is generally mounted to the bottom platform underneath the legs 32 in the track mounting area. The track 24 includes long linear sections 49 positioned underneath the legs. At the front 34 corners of the platform, the carriage track 24 includes arcuate front corners 50 and a short linear section 52 extends across the front 34 of the platform 22. Thus, the carriage track has a U-shaped configuration, opening toward the rear 36 of the bench. The long linear sections 49 terminate at the rear 36 of the platform and stop blocks 53 are positioned at the ends of the track 24 to keep the carriage assemblies from coming off the ends of the track. The stop blocks 53 (FIG. 1) are preferably attached to the lower deck 30 at the rear 36 of the legs 32.

Referring additionally to FIG. 11, the carriage track 24 includes an inner rail 54 and an outer rail 56. The inner rail 54 comprises a piece of angle iron attached to the inner wall plate 41 underneath the lower deck 30 inside the track mounting area defined below the bottom of the platform 22. A vertical leg 57 of the inner rail 54 is attached to the inner wall plate 42, and an inner rail horizontal leg 58 extends farther underneath the platform leg 32 toward the outer wall plates 43. The outer rail 56 also comprises a piece of angle iron with an outer rail vertical leg 60 attached, preferably welded, on an inner one 43A of the outer wall plates 43. A wheel bar 61 is attached to the inner free end of the outer rail horizontal leg 62. The wheel bar 61 preferably extends along the entire outer rail including the arcuate corners 50, and therefore, defines a wheel slot 63 between the outer rail vertical leg 60 and the wheel bar 61 extending along the entire length of the outer rail 56 and track 24. The outer bottom plate 45 is attached to the bottom of the outer rail horizontal leg 62. The horizontal rail legs 58, 62 are preferably coplanar and extend toward each other, and the vertical rail legs 57, 60 are preferably parallel and extend upwardly toward the bottom of the platform 22.

Referring to FIGS. 1 and 14, the platform 22 can preferably be raised and lowered with first and second hydraulic lifts 64, 65, which support the platform above the ground surface. The front lift 64 has a front lift cylinder 68 (shown schematically) and is aligned with the front crossbeam 42, and the rear lift 65 has a rear lift cylinder 69 (shown schematically) and is aligned with the rear crossbeam 40. Each lift includes a pneumatically released lift latch 66 operable to hold the lifts at a desired elevation. When the pneumatic cylinders 70 (shown schematically) are actuated, the latches 66 pivot from engaged positions, in which the latches 66 are operative to hold the lifts at desired elevations, to disengaged positions, which permit the lifts to lower. The lifts 64, 65, lift latches 66, and operation thereof are fully described in U.S. patent application Ser. No. 09/973,586 filed on Oct. 9, 2001, which is fully incorporated herein by reference.

Figure 5:
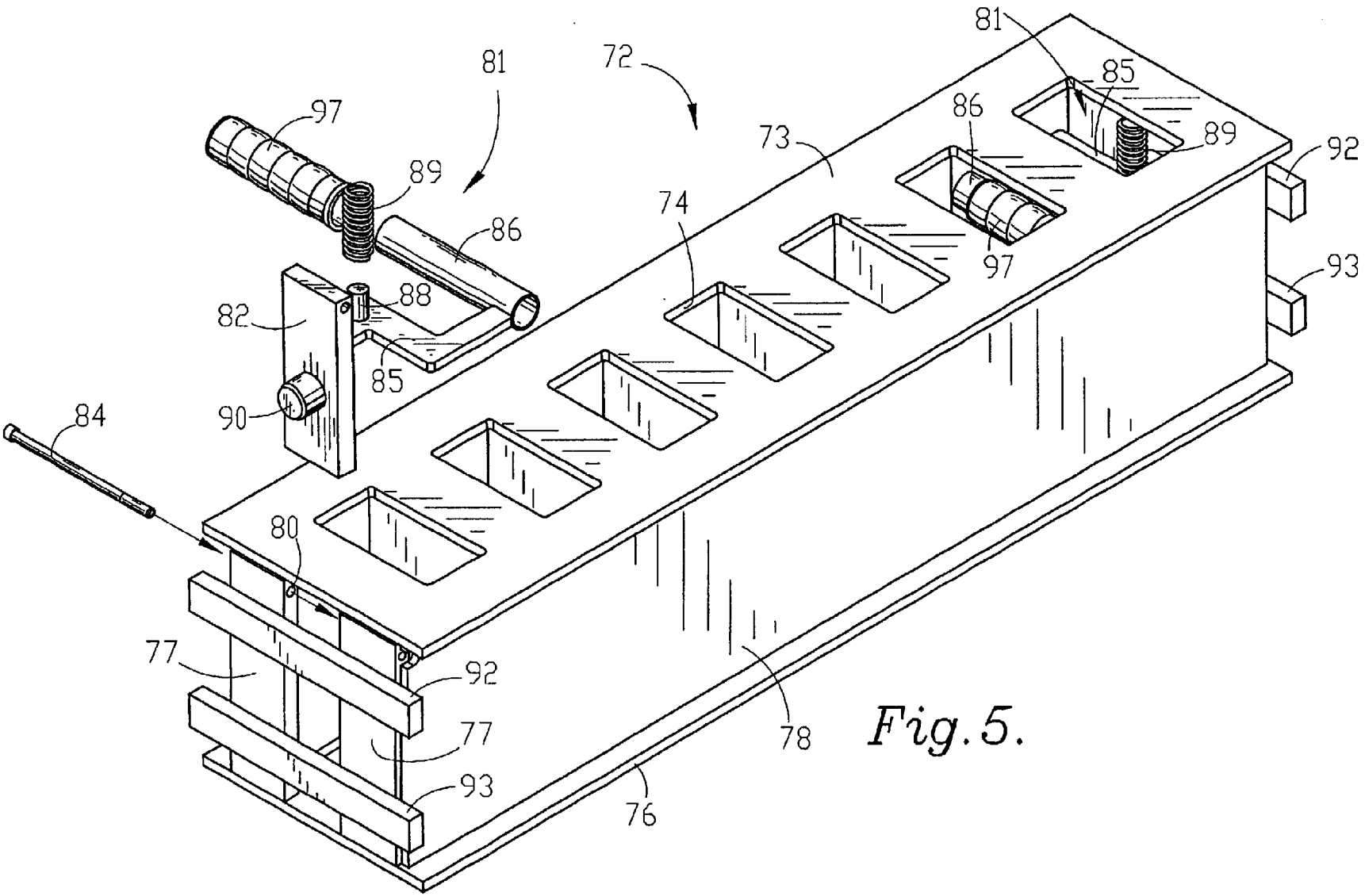
FIG. 5 is a perspective view of a movable crossmember with position locks for use with the bench of FIG. 1.

The bench 20 is also provided with a movable crossmember 72 illustrated in FIG. 5. The movable crossmember 72 includes an upper plate 73 defining additional anchoring apertures 74 and a lower plate 76 attached to the upper plate 73 with end plates 77 and side plates 78. The end plates 77 are bifurcated to define a central opening, and the tops of the end plates have aligned pivot holes 80. Position locks 81 are used at each end of the crossmember 72 to hold the crossmember in a desired location. The position locks 81 are substantially identical and will generally be described with reference to only one lock. The position lock 81 includes a pivot plate 82 pivotally mounted to the end plates 77 by a pivot pin 84 extending through the pivot holes 80. A lever arm 85 extends inwardly from the pivot plate 82 and attaches a release handle 86 to the pivot plate 82. The lever arm 85 also has an upwardly extending post 88 which receives a rod biasing member 89, preferably a compression spring. A lock rod 90 extends outwardly from the pivot plate 82 in a direction substantially opposite to the lever arm 85. If desired a grip enhancing and padding member 97 is placed over the release handle 86.

Referring additionally to FIG. 1, pairs of upper and lower slide bars 92, 93 are attached to the end plates 77 in a spaced, horizontal orientation. The slide bars 92, 93 receive a slide track 94 between them. Opposing slide tracks 94 are attached to the inner wall plates 41 of the platform 22 legs 32 and define a plurality of substantially equally spaced lock openings 96, which are preferably cylindrical. The rod-biasing member 89 is engages the lever arm 85 and the upper plate 73. Thus, the rod-biasing member 89 is compressed between the lever arm and the upper plate, and the post 88 holds the biasing member 89 in position. The rod biasing member 89 forces the pivot plate 82 against the slide bars 92, 93, so that the lock rod 90 extends between the bifurcated end plates 77 and the slide bars. The lock rod 90 has sufficient length to extend beyond the slide bars 92, 93 and is configured for insertion in the lock openings 96. When the lock rods 90 of the position locks 81 are aligned with the lock openings 96, the rod biasing members 89 force the lock rods into the lock openings. When an operator pulls up on the handle 86, the force of the rod biasing member 89 is overcome, and the pivot plates 82 pivot away from the slide bars retracting the lock rods 90 from the lock openings 96. Once the lock rods 90 are retracted, the slide bars 92, 93 are free to slide on the slide track 94.

Figure 6:
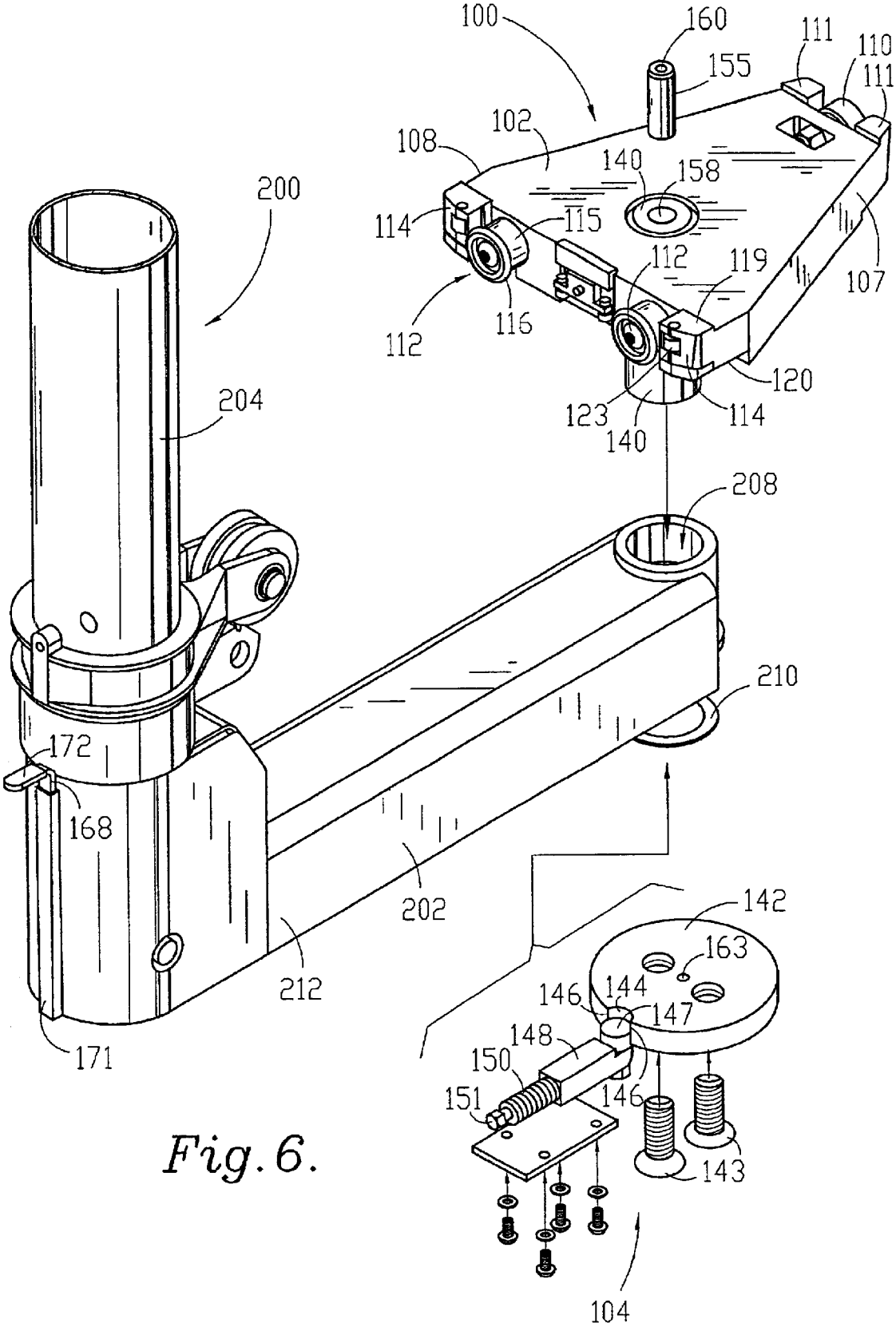
FIG. 6 is a fragmentary perspective view of one of the pulling assemblies of FIG. 1 having a corresponding carriage assembly, illustrated in FIG. 2, exploded away from the pulling assembly.
Figure 7:
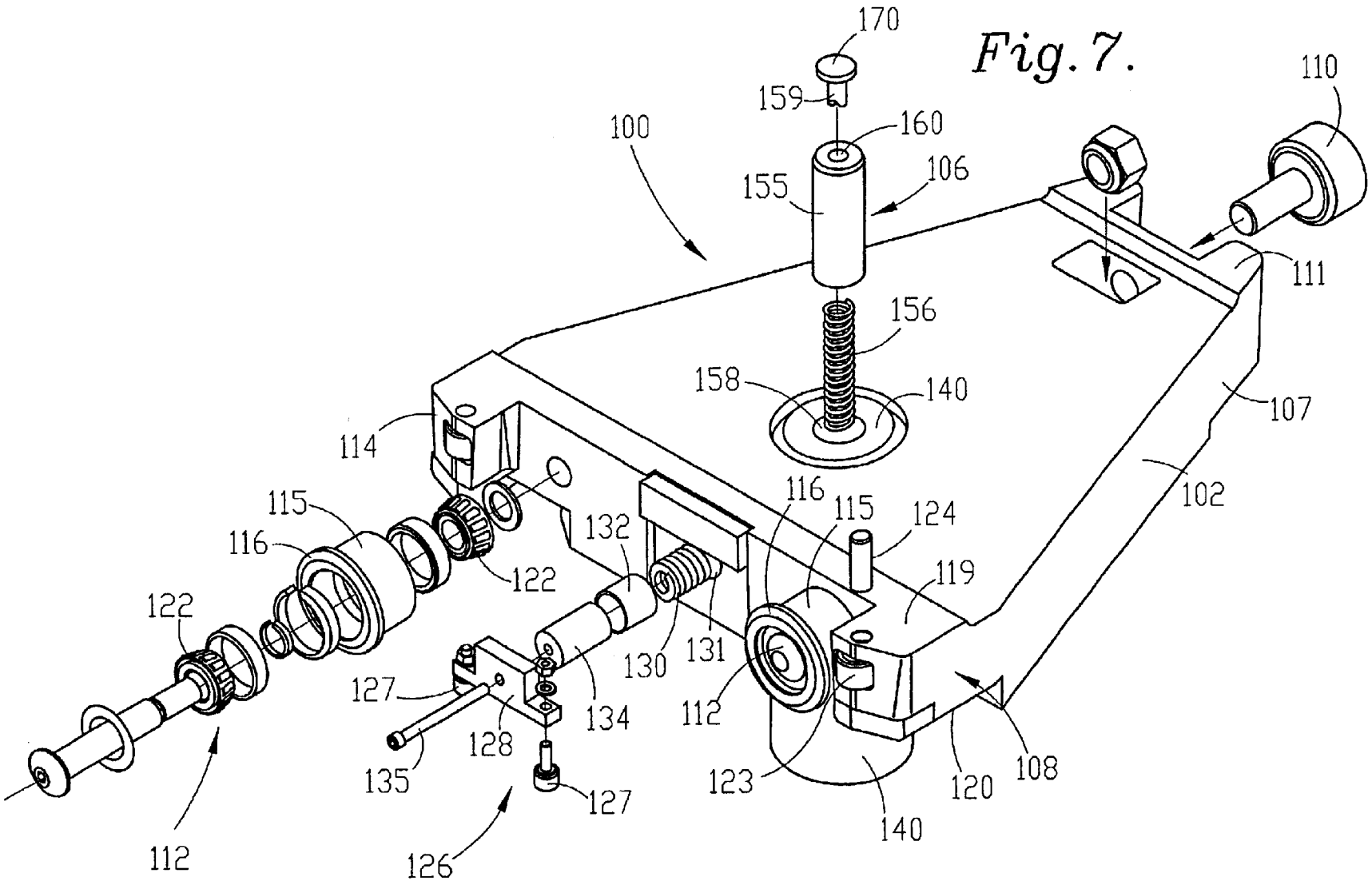
FIG. 7 is a partially exploded perspective view of a portion of the carriage assembly of FIG. 2.

Referring to FIGS. 6, 7, and 11, the carriage assembly 100 includes a carriage body 102, a tower positioning mechanism 104, and a locking mechanism 106. The carriage body 102 has a generally trapezoidal perimeter with an inwardly facing narrow end 107 and an outwardly facing wide end 108. The narrow end 107 rotatably mounts a cylindrical inner wheel 110 between protective fingers 111. The inner wheel 110 is positioned high on the body 102 and extends a small distance above the fingers, so that has the carriage assembly rolls along the track 24, the inner wheel rolls against the bottom of the platform 22. More specifically, the inner wheel 110 rolls against the lower deck 30 as seen in FIG. 11. The wide end 108 rotatably mounts a pair of outer wheels 112 between an outer pair of protective fingers 114. The outer wheels 112 extend a small distance below the outer protective fingers and roll on top of the wheel bar 61 of the outer rail 56 as the carriage assembly is moved along the track 24. Because the carriage assembly 100 alone supports the pulling assembly 200 as it is moved, the weight of the pulling assembly tilts the carriage body and forces the inner wheel upward and the outer wheels downward.

As best illustrated in FIG. 11, when the pulling assemblies 200 are applying force to a vehicle chassis (a pull), this relationship is typically reversed, and a recessed bottom surface 118 of the narrow inner end 107 is forced against the inner rail horizontal leg 58. Thus, the recessed bottom surface 118, not the inner wheel 110 bears the load when the pulling assembly applies force. Similarly, a raised top surface 119 of the wide outer end 108 is forced against the lower deck 30 of the platform. Therefore, when the forces are greatest, which is during a pull, the carriage body 102 not the wheels 110, 112 bears the load of the pull. When the carriage is rolling, the recessed bottom surface 118 of the narrow end 107 also provides clearance from the inner rail 54, and the wide end 108 has a similar recessed surface 120. While the wheels are positioned so that during a pull they typically are not exposed to force, there are certain pulls during which it is inevitable that some force will be transmitted to the wheels. To accommodate this force, the wheels are mounted with two tapered thrust bearings 122 (FIG. 7) placed in opposite orientations to bear load in either direction, and the wheels protrude only small distances beyond the protection of the carriage body.

Referring to FIGS. 7 and 11, the outer wheels 112 have an elongated cylindrical section 115 for rolling on the wheel bar 61. The outer wheels 112 also include a circumferential ridge 116 spaced away from the carriage body 102. The ridge 116 has a larger diameter than the cylindrical section 115. The ridge 116 is received in the wheel slot 63 and engages the inner side of the wheel bar 61 to stabilize and secure the carriage assembly in the track 24. To keep the carriage assembly from binding in the track 24 as it is moved around the corners 50, two vertical axis rollers 123 are rotatably mounted by axles 124 on the outer surfaces of the protective fingers 114 of the wide end 108. The rollers 123 protrude from the fingers 114 and engage and roll against the outer rail vertical leg 60 allowing the carriage assemblies to move smoothly around the corners 50 of the track. Because of the trapezoidal shape of the carriage bodies, several pulling assemblies 200 can be positioned in a corner with minimal spacing. Specifically, the narrow ends 107 of the carriage bodies allow the bodies 102 to move closer together even at the smaller radius of the inner rail 54.

Referring to FIG. 7, the carriage body also has a guide assembly 126 centrally mounted on the wide end 108 of the carriage body 102. The guide assembly 126 is positioned between the outer wheels 112 and includes two vertical axis guide rollers 127 mounted at opposite ends of an elongated guide bar 128. A guide spring 130 is held in a guide aperture 131 formed in the wide end 108. A guide collar 132 keeps the spring engaged with a guide plunger 134 that presses against the guide bar 128. A tension control rod 135 threads into the base of the guide aperture 131 to hold the guide assembly 126 together and compress the guide spring 130. The guide rollers 127 are aligned to engage the exposed side 136 of the wheel bar 61. By threading the tension control rod 135 in and out, the positions of the guide rollers are adjusted relative to the wheel bar 61. Preferably, the guide spring 130 is compressed, so that there is approximately 0.005 inch clearance between the guide rollers 127 and the wheel bar.

Referring additionally to FIG. 11, as the carriage assembly 100 and pulling assembly 200 are pushed along the track 24, the carriage assembly tends to twist in the track. As the carriage assembly starts to twist, one of the guide rollers 127 engages the wheel bar 61 and rolls against its exposed side 136. When the guide roller 127 contacts the wheel bar, the carriage assembly is forced toward a correct orientation in the track 24. The force applied by the guide rollers is dampened by the guide spring 130 and guide collar 132, which absorb the force and allow the guide bar 128 to twist a small amount. Thus, the guide assembly inhibits binding of the carriage assembly along the linear sections 49 of the carriage track 24.

Figure 9:
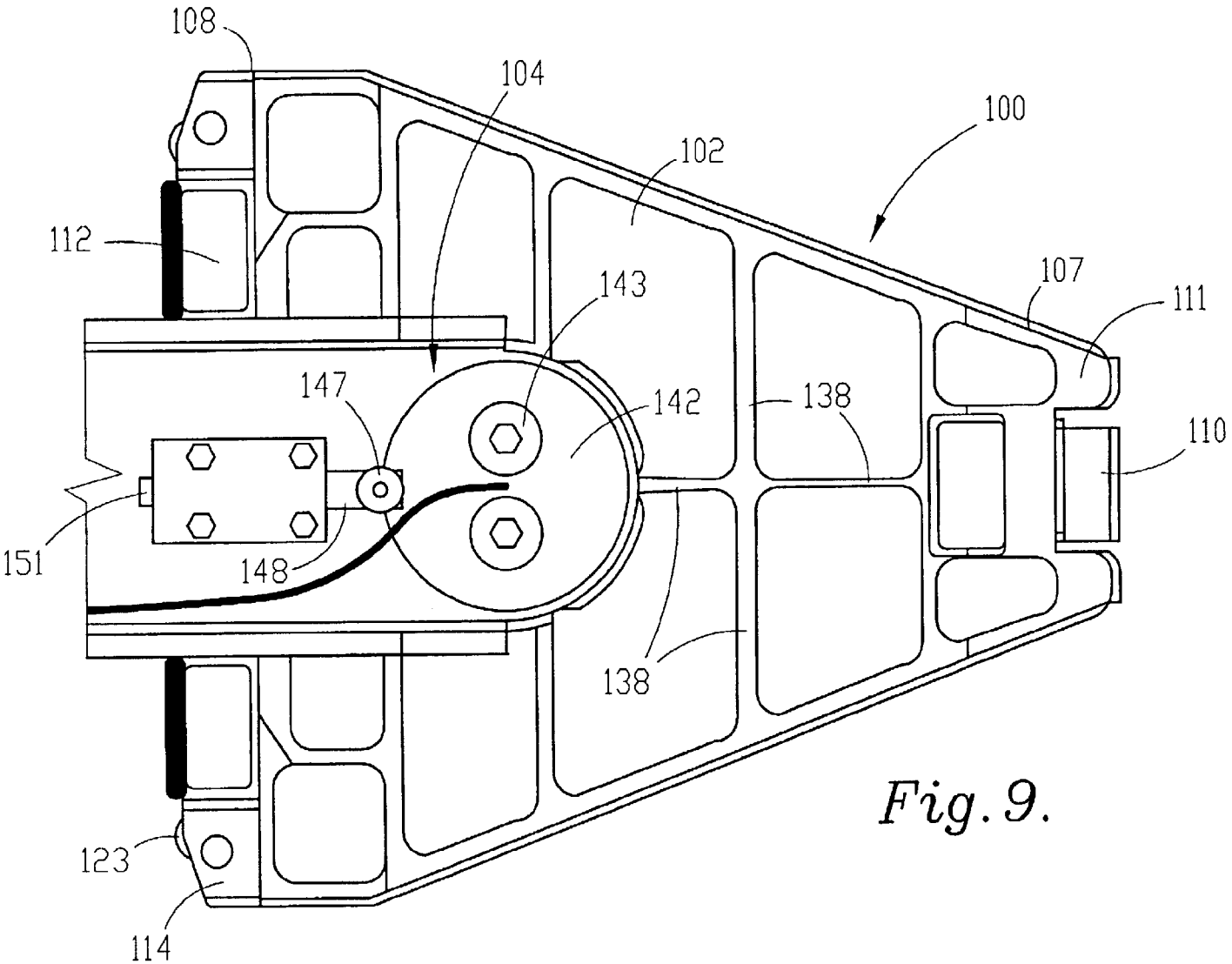
FIG. 9 is a fragmentary enlarged bottom view of the carriage assembly of FIG. 8.

Referring to FIGS. 7 and 9, the carriage body 102 is substantially hollow with a plurality of frame members 138 extending across the body 102 making it more rigid. A pivot cylinder 140 is received in and is part of the carriage body. The pivot cylinder extends from the top of the body 102 and protrudes from the bottom of the carriage body 102 for pivotally mounting the pulling assembly 200 to the carriage assembly 100.

The tower positioning mechanism 104 keeps the pulling assembly from pivoting when an operator pushes on the pulling assembly to position it. Referring to FIGS. 6 and 9, the positioning mechanism 104 includes a notch plate 142. Two fasteners 143 join the notch plate 142 to the bottom of the pivot cylinder 140 thereby holding a tower arm 202 of the pulling assembly 200 on the pivot cylinder 140. The notch plate 142 defines a notch 144 in its perimeter edge. The notch is approximately one-half of a circle, and preferably, the corners 146 of the notch are not rounded. A circular pawl follower 147 is attached to a pawl shaft 148. The follower is sized to fit in the notch 144, and the shaft 148 is slidably mounted on the tower arm 202. The pawl is preferably free to rotate on the shaft 148. A pawl biasing member 150, preferably a pawl compression spring, engages the shaft 148 and forces the circular pawl 147 against the notch plate 142. When the pawl 147 is aligned with the notch 144, the pawl spring 150 biases the pawl into the notch. A mounting plate 152 and pawl fasteners 154 mount the pawl 147 and pawl spring 150 to the tower arm. A compression bolt 151 attaches the pawl spring to the pawl shaft, and the compression bolt 151 is operable to adjust the force with which the pawl 147 is pushed into the notch 144. The tighter the bolt 151, the greater the force. While several of the positioning mechanism components are mounted on the pulling assembly, they are still considered part of the carriage assembly for purposes of definition.

When the locking mechanism 106 locks the carriage assembly 100 in a selected location on the track 24, an operator can force the pawl out of the notch 144 allowing the pulling assembly to pivot on the carriage assembly 100. When the carriage assembly 100 is free to roll on the track, the force applied by the operator moves the pulling assembly and the carriage assembly. Thus, the force required to remove the pawl 147 out of the notch is greater than the force required to move the pulling and carriage assemblies. The substantially square corners 146 of the notch 144 contribute to this force differential. Therefore, when the locking mechanism 106 is not engaged, the operator can move the pulling assembly in its easiest transport position, which is substantially perpendicular to the platform. When the operator wants to pivot the pulling assembly, the locking mechanism is engaged allowing a higher force to be applied to the pulling assembly without moving it.

Figures 8, 12:
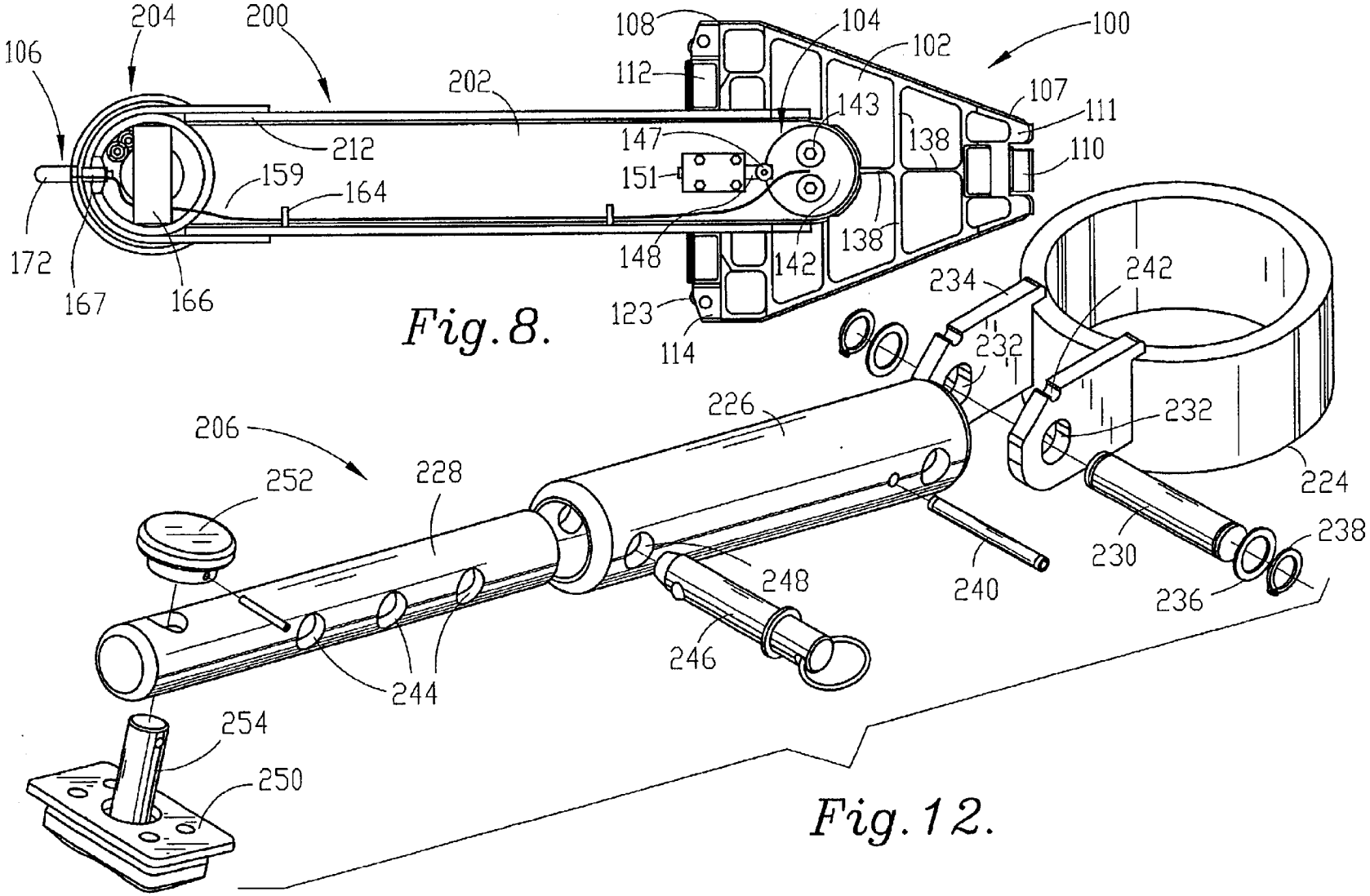
FIG. 8 is a bottom elevational view of one of the pulling assemblies of FIG. 1 assembled to a corresponding carriage assembly of FIG. 2.
FIG. 12 is an exploded perspective view of a force arm of the pulling assembly.

Referring to FIGS. 7, 8, and 11 the locking mechanism 106 includes a lock pin 155 and a lock pin biasing member 156, preferably a lock spring in compression. The pivot cylinder 140 of the carriage body 102 defines a lock pin opening 158 in the top of the body, and the lock pin 155 and lock spring 156 are received in the lock pin opening 158. Because the lock pin opening 158 is centrally positioned in the pivot cylinder 140, the axis of the lock pin 155 is coaxial to the pivot axis of the pulling assembly 200. The lock pin 155 is slidably received in the opening 158 and moves between an extended locking position and a retracted unlocked position. The lock pin opening 158 defines a lock pin shoulder 174 limiting how far the lock pin can retract into the carriage body. The lock pin opening 158 also defines a lock spring shoulder 175, which positions the lock spring in the opening 158. In the extended position, the lock pin 155 extends into a selected one of the lock pin apertures 48 (FIG. 2) of the lower deck 30. An elongated release cable 159 is passed through an eyelet 160 in the top of the lock pin 155, the center of the lock spring 156, a small cable passage 162 through the pivot cylinder 140, and a cable aperture 163 (FIG. 6) in the center of the circular notch plate 142. The cable 159 extends along the tower arm 202 and is fastened to the arm 202 with cable guides 164.

Figure 10:
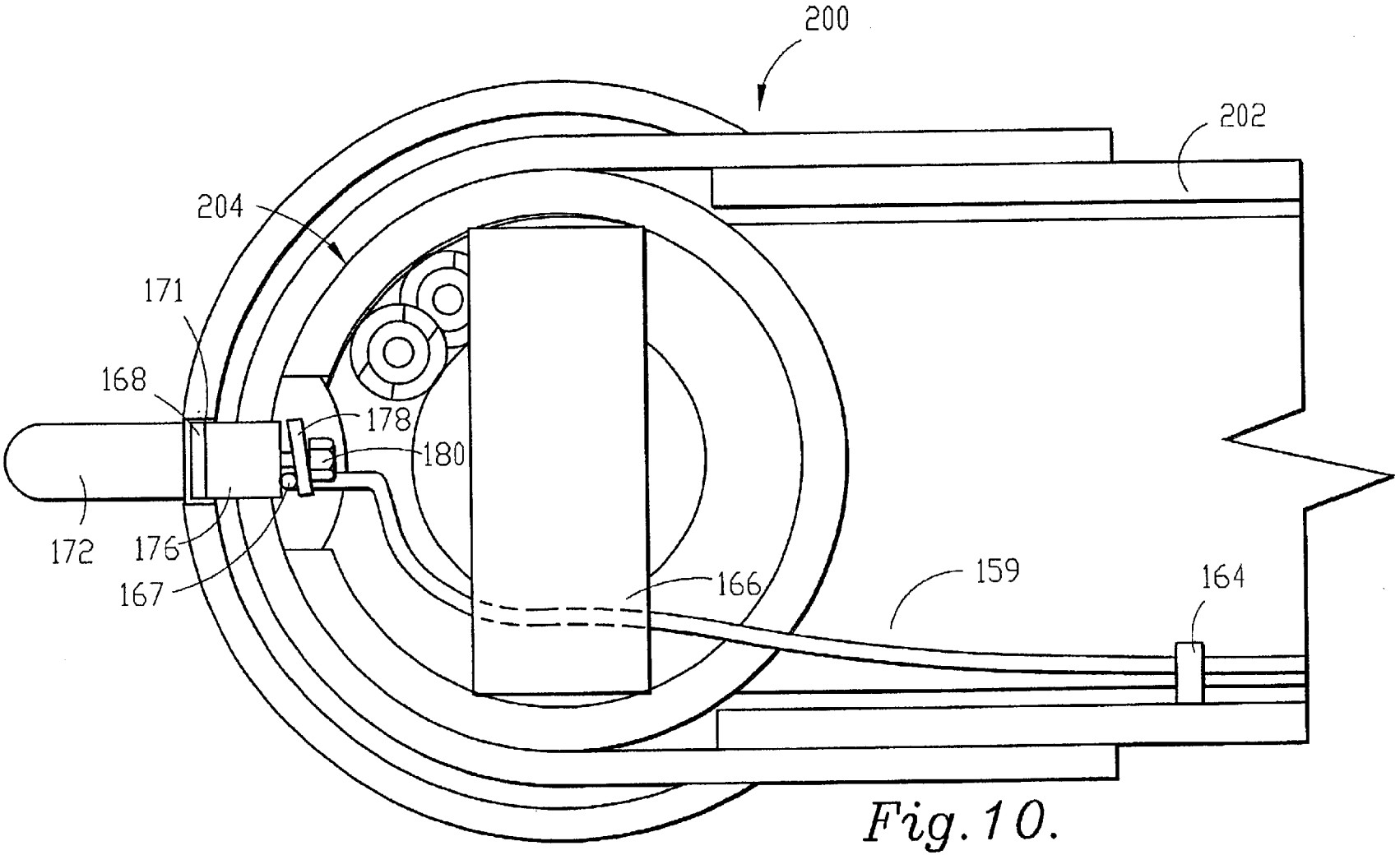
FIG. 10 is a fragmentary enlarged bottom view of the pulling assembly of FIG. 8.

Referring additionally to FIG. 10, the cable 159 is then passed over a bottom inversion dowel 166, and its free end 167 is clamped to a release handle 168 between a handle block 176 and cable pinch washer 178. A cable pinch bolt 180 extends through the washer 178 and threads into the block 176 to pinch the free end 167 of the cable between the washer 178 and the block 176. The first end of the cable 159 has a drum 170 (FIG. 7) that forms a T-end of the cable, and the T-end is too large to fit through the lock pin eyelet 160. Thus, the cable 159 is in tension between the lock pin 155 and the release handle 168 thereby holding the lock spring 156 in compression. Referring to FIGS. 6 and 10, the release handle 168 is slidably received in a release channel 171 mounted on the outside of a pulling tower 204 of the pulling assembly 200 for easy operator access. The upper end of the release handle 168 has a handle flange 172 adapted to receive a substantial downward force from an operator's hand.

As an operator pushes downwardly on the handle flange 172 the tension cable 159 retracts the lock pin 155 and compressing the lock spring 156. Because the cable passes over the inversion dowel 166, it is an easily applied downward force, which disengages the locking mechanism 106. The operator then maintains downward pressure on the release handle 168 until the pulling assembly is near a desired location. Then the handle 168 is released, and the top of the lock pin 155 slides against the lower deck 30 until it is aligned with the closest lock pin aperture 48. Once aligned, the lock spring 156 forces the lock pin 155 into the lock pin aperture 48 defined in the lower deck 30 thereby locking the carriage assembly 100 in place relative to the track 24 and platform 22.

Figure 13:
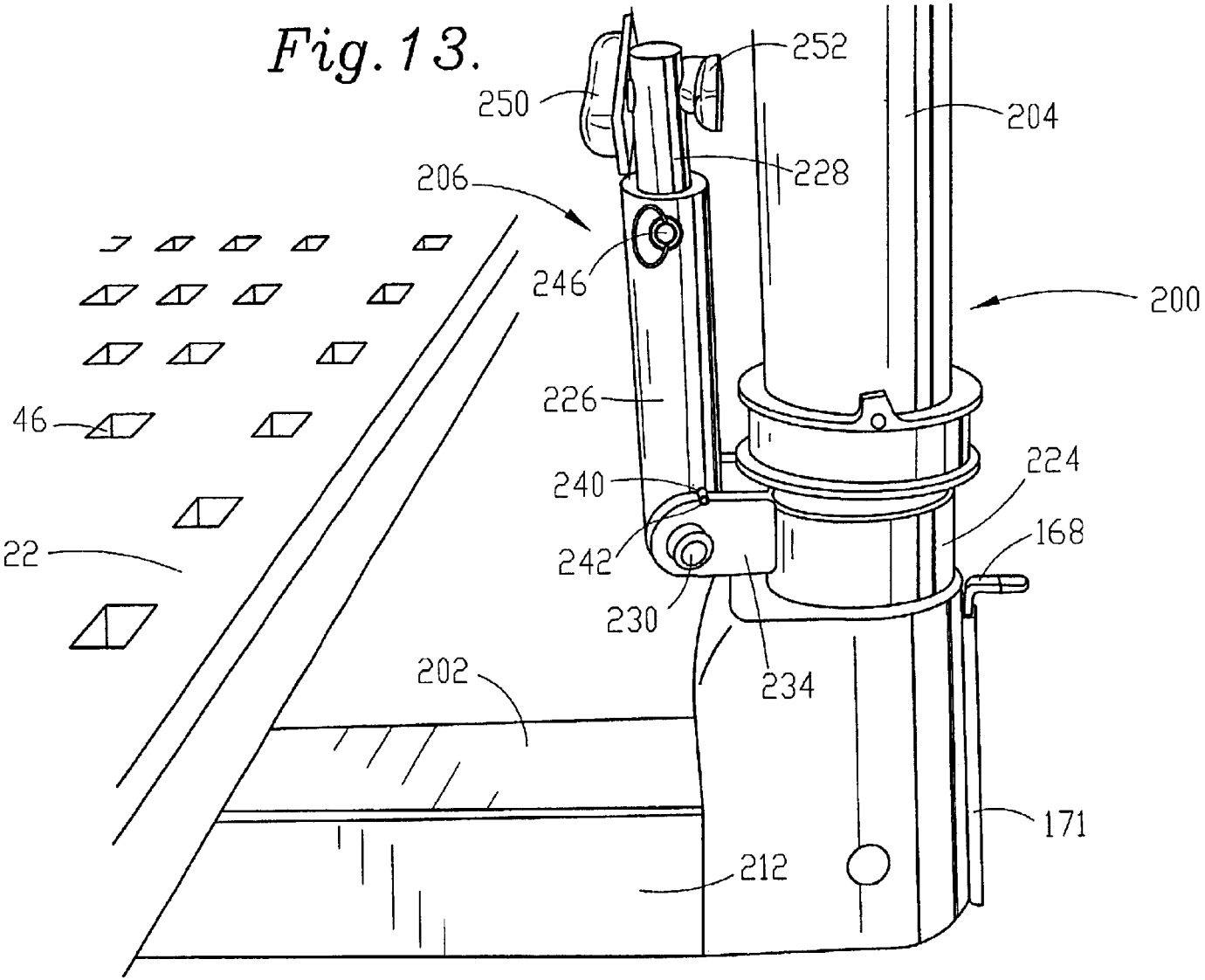
FIG. 13 is a fragmentary perspective view of the bench of FIG. 1 illustrating the force arm of FIG. 12.

Referring to FIGS. 1 and 13, the pulling assembly 200 includes a tower arm 202, a pulling tower 204, and a force arm 206. Referring additionally to FIG. 6, the tower arm 202 is a substantially rigid member extending substantially horizontally between the pulling tower 204 and the carriage assembly 100. The inner end of the tower arm provides a cylindrical opening 208, which pivotally receives the pivot cylinder 140 of the carriage body 102. The notch plate 142 and the notch plate fasteners 143 hold the tower arm on the pivot cylinder, and a circular bushing 210 is interposed between the notch plate and the tower arm to reduce friction and enhance relative rotation. The outer end 212 of the tower arm supports the pulling tower 204.

The pulling tower 204 is preferably telescoping with an extendable head 214 that is powered by a hydraulic cylinder 216 (shown schematically in FIG. 14) housed inside the pulling tower. A chain 217 extends over and is secured by the head 214. Typically, the chain 217 is threaded around a pulley 218, which is pivotally mounted on the tower 204 by a pulley collar 220. A connector 222, such as a hook, is secured to the end of the chain, and is operable to attach to the vehicle chassis.

Referring to FIGS. 12 and 13, the force arm 206 is pivotally mounted on the pulling tower by a cylindrical force arm collar 224 rotatably received around the tower. The force arm 206 is preferably telescoping and has a proximal segment 226 and a distal segment 228. Thus, the length of the force arm is adjustable. The proximal segment 226 is mounted on the arm collar 224 by a force arm axle 230 extending through slots 232 defined in mounting flanges 234 extending from the arm collar 224. The arm axle 230 allows the force arm 206 to pivot up and down while the arm collar 224 permits horizontal motion. Therefore, the force arm moves in three dimensions. The arm axle 230 is held in place by a washer 236 and a split ring 238 at each end. The proximal segment 226 includes a storage dowel 240, which preferably comprises an interference split ring dowel. When the force arm 206 is not in use, it is raised to a substantially vertical orientation; the arm axle 230 is raised in the flange slots 232, and the ends of the storage dowel are rested in storage notches 242 formed in the top surfaces of the mounting flanges 234.

The distal segment 228 has a smaller diameter and preferably slides inside the larger diameter proximal segment 226. The distal segment 228 includes three length adjustment apertures 244 spaced along its length. A key pin 246 extends through a key pin aperture 248 in the proximal segment 226 and a selected one of the adjustment apertures 244 to attach the distal and proximal segments. The distal segment 228 pivotally holds an anchoring foot 250, which is rotated with a top mounted, foot handle 252. The anchoring foot 250 is configured for placement in either the anchoring apertures 46 (FIG. 1) of the platform upper deck 28 or the anchoring apertures 74 (FIG. 5) of the movable crossmember 72.

After the carriage assembly 100 has been locked in a desired location, the pulling tower 204 is pivoted near a desired angle relative to the platform and vehicle chassis. Then the force arm 206 is removed from its vertical storage position (FIG. 13) and pivoted to an angle substantially in line with the chain 217 and the direction of the pull. Alternatively, the force arm can be pivoted to another desired angle and location. Then the anchoring foot 250 is rotated into alignment with the nearest anchoring aperture 46, 74 and inserted into that aperture, so that shearing forces are applied to the deck plate and through a larger cross-section area made up of the combination of the areas of the lock pin 155 and the anchoring foot dowel 254. Thus, the foot handle 252 and anchoring foot 250 lock the force arm in place. The force arm 206 substantially reduces the forces, such as the bending force, transmitted through the carriage assembly 100. Thus, the force arm plays a substantial role in allowing application of pulling forces equal or greater than those applied by previous benches while providing a pulling assembly supported entirely by a movable carriage mounted to an elevated platform 22 of a vehicle-straightening bench 20. Further, the force arm can be loaded in tension or compression, which allows pulling on both sides of the tower.

Referring to FIGS. 14A and 14B, the bench control system 300 includes a power system 302, a hydraulic control circuit 304, and a pneumatic control circuit 306. The control system 300 utilizes a programmable logic controller (PLC) 308 and a remote control 310 seen schematically in FIG. 14B and illustrated in FIG. 1.

The power system 302 includes a motor 312, a first or front/lift hydraulic pump 314, and a second or rear hydraulic pump 316. The pumps 314, 316 are powered by the motor 312 and draw hydraulic fluid from a common reservoir 318. A relief valve 320, which preferably releases pressure at approximately 3800 pounds per square inch, is provided for each pump. The motor and pumps are controlled by the PLC 308.

The hydraulic control circuit 304 includes six hydraulic valves 322–332. Valve one (V1) 322 comprises a three position, four way, tandem center, spring to center, spool type, double solenoid valve in operative fluid communication with the front/lift pump 314 and the tower cylinders 216. Thus, V1 includes an up solenoid 334 and a down solenoid 336. Valve six (V6) 332 comprises a two position, two way, normally closed, one way poppet solenoid valve also in operative fluid communication with the front/lift pump 314 and the tower cylinders 216. When V1 is off, ports A and B are blocked and pressure flows to the reservoir 318. When the up solenoid is energized by the PLC, pressure flows to V6 and then to port A while pressure from port B flows to the reservoir 318. When the down solenoid 336 is activated, pressure flows to port B while pressure from port A flows to V6 and hence to the reservoir if V6 is on. When V6 is on, pressure flows freely to and from port A to V1, and when V6 is off, pressure is held in port A; and pressure continues to flow from V1 to port A through V6. Thus, to retract the tower cylinders 216 and lower the towers 204, V6 is turned on and the V1 down solenoid 336 is turned on. To raise the towers, the V1 up solenoid 334 is turned on. Additionally, to raise the towers, valves three and five 226, 230 must also be off, as described below. This assures that the lifts are at rest before the towers can be activated for a pull. If desired, the hydraulic cylinders are double acting cylinders.

Valve two (V2) 224 and valve four (V4) 228 are both two position, two way, normally closed, bi-directional poppet solenoid valves, and valve three (V3) 226 and valve five (V5) 230 are both two position, two way, normally open, one way poppet solenoid valves. V2 and V4 are provided with flow control orifices 338 to control the speeds of the lifts. V2 and V3 control the front lift 64 and front lift cylinder 68 and are in operative fluid communication with the front pump 314 and the front lift cylinder 68. When V2 is off, it holds pressure in port L1 and blocks further pressure from entering port L1. When V2 is on, it allows pressure to flow in and out of port L1 and hence the front lift cylinder 68. When V3 is off, it allows pressure to flow to and from V1; this is why V3 must be off to raise the towers. When V3 is on it blocks flow to V1 thereby forcing pressure to V2. Thus, to raise the front lift 64 with the front lift cylinder 68, V2 and V3 must both be on. To lower the front lift, only V2 is turned on.

V4 and V5 operate similar to V2 and V3. V4 and V5 control the rear lift 65 and rear lift cylinder 69 and are in operative fluid communication with the rear pump 316 and the rear lift cylinder 69. When V4 is off, it holds pressure in port L2 and blocks further pressure from entering port L2. When V4 is on, it allows pressure to flow in and out of port L2 and hence the rear lift cylinder 69. When V5 is off, it allows pressure from the rear pump to flow to the reservoir 318. When V5 is on it blocks flow to the reservoir thereby forcing pressure to V4. Thus, to raise the rear lift 65 with the rear lift cylinder 69, V4 and V5 must both be on. To lower the front lift, only V4 is turned on. Therefore, the lifts are independently controlled. The back sides of the lift cylinders 68, 68 are used as reservoirs that are connected to the main reservoir 318. Thus, when only V4 and V2 are turned on, they allow the pressure to equalize and gravity lowers the lifts. Preferably, the orifice 338A for the front lift is smaller than the orifice 338B for the rear lift, so that the front lift lowers a little slower than the rear lift.

Using two pumps to independently control two lifts provides sufficient flow to raise and lower the lifts at acceptable speeds. Having only one of the pumps operate the pulling towers provides a small enough flow rate to move the tower cylinders 216 at a sufficiently slow rate for superior control of the pulls. Thus, the bench is safer and more exacting during pulls. Further, when only one pump is in use, the power system generates less heat and energy preserving the pump and extending the life of the hydraulic fluid.

The pneumatic control circuit 306 is provided with a pressure tank 340 which feeds air pressure to auxiliary tool connections 342 and a flow regulator and filter 344. A pneumatic, 2 position, four way, bi-directional solenoid valve 346 controls air flow to the pneumatic cylinders 70. When the pneumatic valve 346 is off, pressure is vented away from the cylinders 70 thereby retracting the cylinders and allowing the first and second lift latches 66 to remain in the respective first and second engaged positions. When the pneumatic valve 346 is on, pressure is applied to the cylinders 70 and the lift latches 66 are pivoted to their respective first and second disengaged positions.

The PLC 308 is operable to open and close the valves 322–332, 346 as described above based on the switch activation in the remote control 310. The remote control includes five pressure switches 348–356 coded S1 through S5. Each switch is provided with a corresponding light emitting diode (LED) 358–366 coded D1 through D5. When unlock switch S3 352 is activated, D3 LED 362 illuminates red and the PLC turns on the pneumatic valve 346 to unlock the lift latches 66. Then the operator can select the front lift 64 by pressing front switch S5 356, the rear lift 65 by pressing rear/back switch S4 354, or both. When the S5 and S4 switches are pressed, LED D5 366 and LED D4 364, respectively, are illuminated green. Then the operator can press down switch S1 348 to lower a selected lift or both lifts depending on which lifts are selected on the remote control 310. Activation of the down switch S1 activates LED D1 358 illuminated red while activated. The operator can also raise a selected lift or both lifts by pressing the up switch S2 350, which causes LED D2 360 to illuminate while the lifts are being raised. To keep the lift latches 66 from interfering with the lift while it is being raised, the PLC 308 is programmed to prevent the lift latches 66 from being raised into the unlocked position during lifting. If both S5 and S4 are off and S3 is locked, the towers can be raised and lowered by S2 and S1, respectively. Thus, an operator can control all power components of the bench 20 from the remote control 310 making the bench safer than previous vehicle-straightening apparatus. Further, when no power component is active, there are no illuminated lights 358–366 on the remote control. Thus, a quick glance at the control 310 tells the operator if anything is active and needs to be shut down further increasing safety.

In operation, the front and rear lifts 64, 65 are lowered and a vehicle is driven onto the platform 22. The platform 22 is then raised to a comfortable working height by activation of the switches on the remote control 310 as described above. The anchors 26 are positioned and fixed to the platform 22 and the vehicle chassis. The locking mechanisms 106 of the carriage assemblies 100 are successively unlocked and the pulling towers 204 are moved to desired locations where the locking mechanisms are re-engaged to fix the carriage assemblies relative to the platform 22. An operator then pivots the towers 204 to desired pull angles and anchors the force arms to the platform. The operator then remotely activates the towers 204 with the remote control 310. The towers can be repositioned as many times as needed until the vehicle chassis is substantially restored to its original configuration The vehicle-straitening bench 20 according to the present invention provides increased pulling versatility with enhanced safety. The bench 20 utilizes an additional force bearing member during pulls to further enhance safety and enable the increased versatility. Further, the bench use a PLC and a remote control to actuate power components thereby keeping operators at a safe distance from the power components.

Thus, a vehicle-straitening bench 20 is disclosed which utilizes movable carriage assemblies with pivotally mounted pulling towers to position the pulling towers at almost any position around a vehicle chassis to restore the chassis to an original configuration with remotely activated power components thereby enhancing efficiency and safety. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A vehicle straightening bench for applying force to vehicle chassis and restore vehicle chassis to desired configurations, the bench comprising:

a vehicle platform including a front, a rear, opposed sides corresponding to a length, a top and a bottom, the vehicle platform being operable to support a vehicle chassis to be straightened, and the vehicle platform defining a plurality of anchoring apertures;

at least one anchor attachable to the platform and operable to secure the vehicle chassis to the platform;

a carriage track mounted on the platform and extending along the length of the platform;

a carriage assembly movably received by the carriage track;

an elongated tower arm having a mounting end attached to the carriage assembly and a distal end opposite the mounting end;

a pulling tower attached to the distal end of the tower arm; and a force arm including a substantially fixed end attached to the pulling tower and a free end operable to attach to the vehicle platform at a selected one of a plurality of attachment locations and operable to pivot three dimensionally relative to the pulling tower.

2. The bench according to claim 1 wherein the force arm comprises an adjustable length.

3. A vehicle straightening bench for applying force to vehicle chassis and restore vehicle chassis to desired configurations, the bench comprising:

a vehicle platform including a front, a rear, opposed sides corresponding to a length, a top and a bottom, the vehicle platform being operable to support a vehicle chassis to be straightened, and the vehicle platform defining a plurality of anchoring apertures;

at least one anchor attachable to the platform and operable to secure the vehicle chassis to the platform;

a carriage track mounted on the platform and extending along the length of the platform;

a carriage assembly movably received by the carriage track;

an elongated tower arm having a mounting end attached to the carriage assembly and a distal end opposite the mounting end;

a pulling tower attached to the distal end of the tower arm; and a force arm including a substantially fixed end attached to the pulling tower; a free end operable to attach to the vehicle platform at a selected one of a plurality of attachment locations; and a pivoting platform lock configured for insertion in the platform anchoring apertures and rotation to lock in the platform anchoring apertures.

* * * * *